US006369682B1

(12) United States Patent
Thompson, Jr. et al.

(10) Patent No.: US 6,369,682 B1
(45) Date of Patent: Apr. 9, 2002

(54) MULTIFUNCTIONAL COIL ASSEMBLY FOR AN INJECTOR

(75) Inventors: David J. Thompson, Jr., Pittsford, NY (US); Jack L. Lantz, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/671,003

(22) Filed: Sep. 27, 2000

(51) Int. Cl.[7] ..... H01F 27/29
(52) U.S. Cl. ..... 336/192; 336/198
(58) Field of Search ..... 335/282; 336/192, 336/198

(56) References Cited

U.S. PATENT DOCUMENTS 5,058,821 A * 10/1991 Yamashita ..... 336/208
5,059,935 A * 10/1991 Ohsawa et al. ..... 335/282
5,281,940 A * 1/1994 Goto ..... 335/282
5,952,908 A * 9/1999 Kubo ..... 336/192
6,181,230 B1 * 1/2001 Broome et al. ..... 336/198

* cited by examiner

*Primary Examiner*—Lincoln Donovan
(74) *Attorney, Agent, or Firm*—John Van Ophen

(57) ABSTRACT

A bobbin has a simple and precise means for locating and securing terminals onto the bobbin for use in a fuel injector. The bobbin has open terminal posts and flange holding notches for locating the terminals on the bobbin, and a flange locking notch for securing the terminals within the framework of the bobbin after connecting a wire and rotating.

16 Claims, 3 Drawing Sheets

MULTIFUNCTIONAL COIL ASSEMBLY FOR AN INJECTOR

TECHNICAL FIELD

The present invention relates generally to a fuel injector. More specifically, the present invention relates to the coil assembly for a fuel injector of an internal combustion engine.

BACKGROUND OF THE INVENTION

Fuel injectors are generally defined as an electromagnetic valve mechanism that sprays fuel into the intake system of an internal combustion engine.

Proper control of the moving portion of a fuel injector improves fuel spray quality while limiting flow rate variation. This moving portion, or guiding valve, opens and closes to allow fuel to pass uniformly through an opening of the injector valve seat. In a fuel injector, the controlling of the guiding valve is based on the generation of energy via a coil assembly.

The coil assembly is a multi-functional device that provides structure to wind wires, structure to support electrical interface elements, structure to capture interface terminals during insertion and termination, and is the energy source that is utilized to generate a magnetic field to open the injector valve.

The coil assembly is comprised of five major pieces. These pieces are a bobbin, two terminals, wire, and a bobbin clip. The terminals are attached to the bobbin through the two terminal posts located on a portion of the bobbin. The wire is wrapped around the winding bay of the bobbin and each end of the wire is wrapped around a portion of a different terminal and secured to the terminal typically by soldering. The portion of the terminals containing the wire is then secured within the framework of the bobbin by attaching a bobbin clip to the bobbin. The other end of the terminals is then available to be connected to a power source. The coil assembly is then placed within a fuel injector. When a current is introduced to the terminals through the power source, the wire creates a magnetic field which causes the coil assembly to energize, which in turn causes the guiding valve to open and allow fuel to pass through an opening in the injector valve seat.

A shortcoming of presently available coil assemblies is the inaccuracies of the method of mechanically pressing the terminals through the bobbin terminal posts because the terminals may bend or may be positioned incorrectly, causing the assembly to be non-useable. Another drawback to known processes is that a clip is added to the assembly to insure that the portion of the terminals containing the wire are fully rotated and secured into the framework of the bobbin. This clip may cause interference in the future assembly if the clip is not attached correctly. Also, this clip has a tendency to become unattached or lost if the clip is not attached correctly. The additional costs associated with re-application of the clip, lost time in failed assemblies due to the loss of the clip, or bent or inaccurately located terminals increase the cost of the injector on a per-vehicle basis.

SUMMARY OF THE INVENTION

It is, therefore, one object of the present invention to provide a fuel injector, for use in an internal combustion engine, having a simple and precise means of centering and securing the terminals in the coil assembly of a fuel injector.

A feature of the present invention is to provide the coil assembly with open terminal posts that provide an entrance for the terminals via a translational push. The open terminal posts are configured such that the terminals are held in place securely yet allowed to rotate. To allow the terminals to be positioned properly, a pair of flange holding notches have been added to the bobbin as well. The open terminal posts and the flange holding notches allow the terminals to be more accurately positioned for height and depth, and thus the secured terminals are more readily available to receive a length of wire that is soldered to the terminals.

An additional feature of the present invention is to provide flange-locking notches that capture the terminals when rotated. This locking feature removes the need for bobbin clips that are used to make sure the terminals are correctly rotated and secured. Part quantity reduction and scrap reduction due to bobbin clip breakage are an advantageous by-product of the elimination of the bobbin clip. Further, there is no longer a need to have an operator to install the bobbin clip, thus further improving the throughput for assembling the bobbin.

Other features and advantages of the present invention will become apparent from the following detailed description that should be read in conjunction with the accompanying drawings.

DETAILED DESCRIPTION OF A PREFERRED EMBODIMENT

Figure 1:
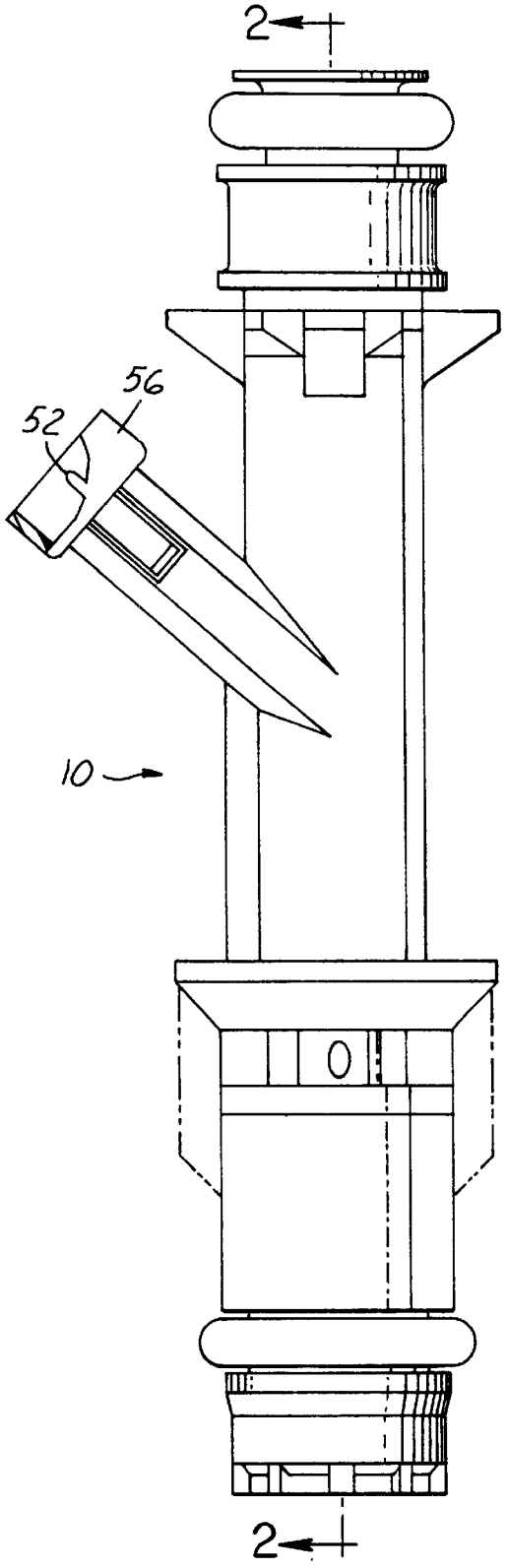
FIG. 1 is a side view of a fuel injector having terminals attached to a power source.
Figure 2:
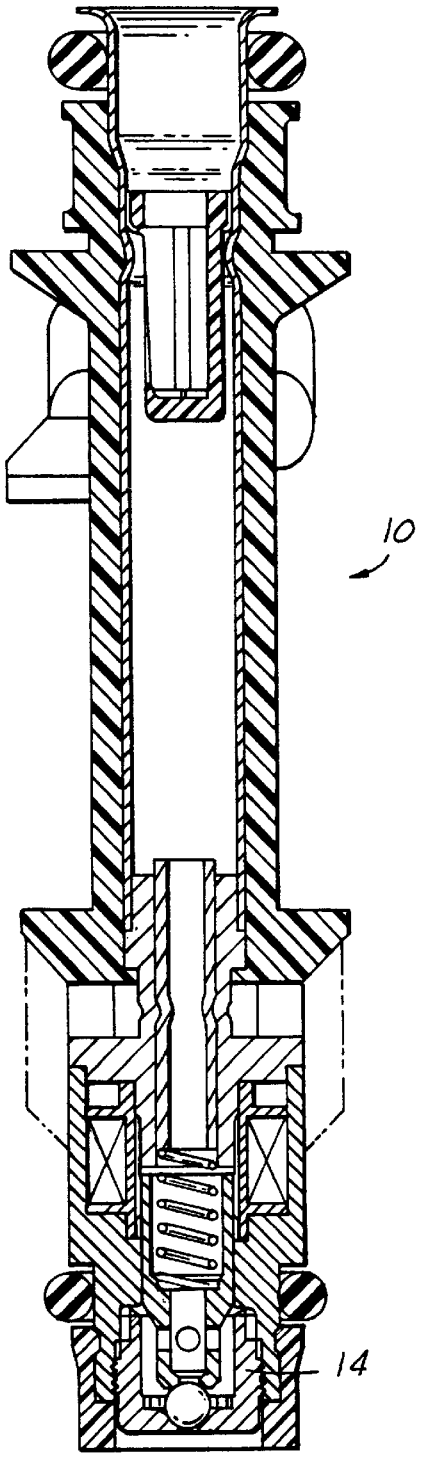
FIG. 2 is a sectional view of the fuel injector of FIG. 1 taken along line 2—2 without the power source attached.
Figure 3:
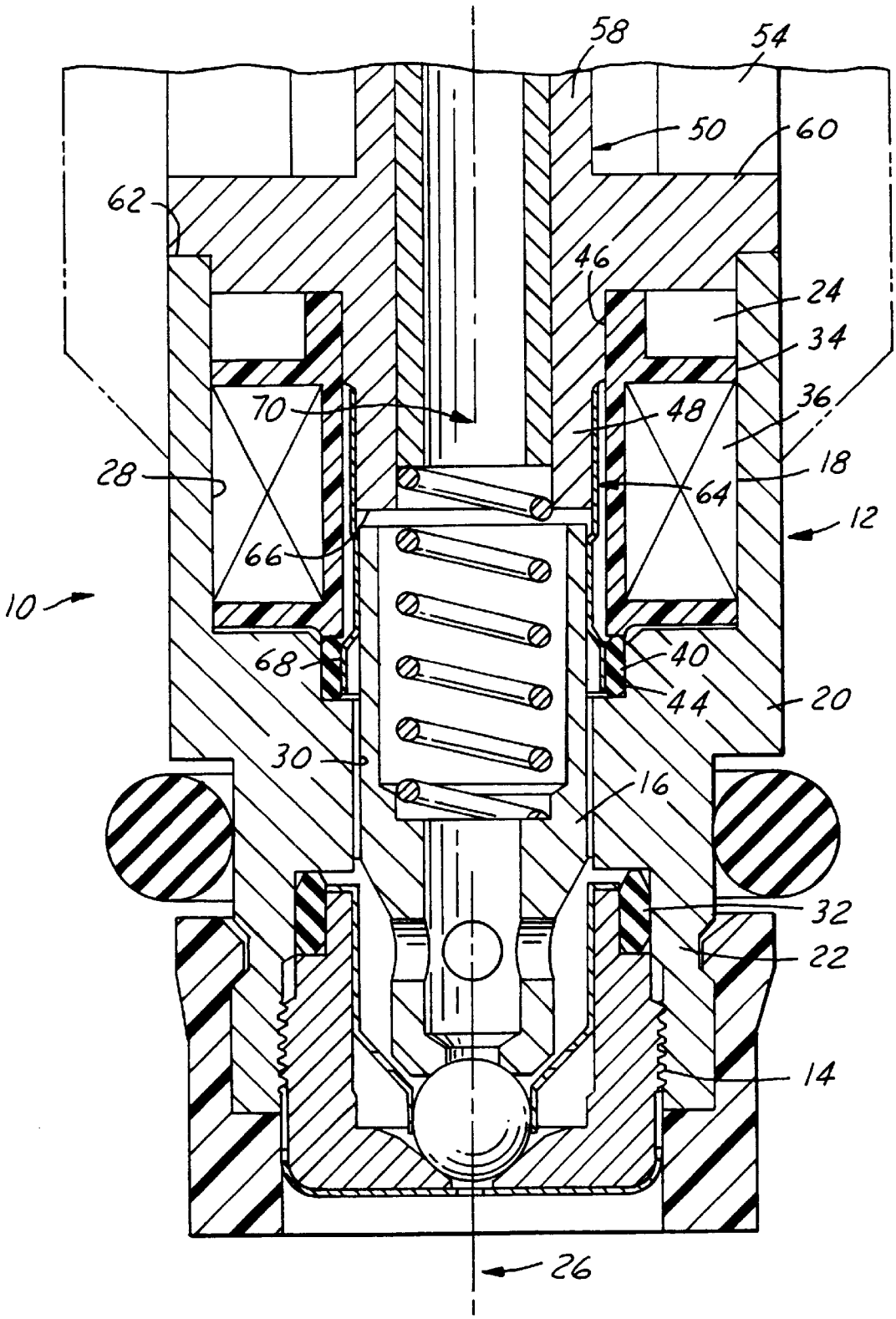
FIG. 3 is an enlarged cross section of a portion of FIG. 2.

Referring to FIGS. 1–3 where an electromagnetic fuel injector 10 generally has a body 12, a nozzle assembly 14, a valve member 16 and a multi-functional coil assembly 18 used to control the movement of the valve member 16.

As illustrated, the body 12 is of cylindrical, hollow tubular configuration and has an external shape permitting direct insertion of injector 10 into a socket of an engine intake manifold (not shown).

The body 12 includes an enlarged upper solenoid case portion 20 and a lower end nozzle portion 22 of reduced internal and external diameter relative to the solenoid portion 20. An external cylindrical cavity 24 is formed in the body 12 by a stepped bore therethrough that is substantially coaxial with the axis 26 of the body. In the illustration shown, the cavity 24 includes a cylindrical upper wall 28, a cylindrical intermediate wall 30 and a cylindrical lower wall 32. Wall 30 is of a reduced diameter relative to upper and lower wall portions 28 and 32, respectively.

Multi-functional coil assembly 18 is disposed within the enlarged upper solenoid case portion 20 and includes a spool-like bobbin 34 supporting a wire 36 (shown as 222 on the preferred embodiments). A preferred embodiment of the bobbin 34 is detailed in FIGS. 4 through 7 below. A resilient sealing member such as O-ring 40 is disposed between the bobbin 34 and a seal shoulder 44 in the cylindrical intermediate wall 30. The bobbin 34 is provided with a central bore 46 therethrough configured to encircle the lower reduced diameter portion 48 of pole piece 50. The bobbin 34, in conventional designs, contains two hollow terminal posts (a preferred embodiment of the terminal posts 200 is shown in FIGS. 4 through 7), each of sufficient diameter (0.56+/−0.02 mm in conventional designs) to receive and hold a terminal 52 of sufficient diameter (0.64+/−0.1 mm in conventional designs) therethrough, wherein each of the pair of terminals 52 is also operatively connected to an end of the wire 36 and each such terminal 52 extends from the terminal posts through the outer, overmolding casing 54, to terminate in a connector 56 for connection of the fuel injector to a suitable source of electrical power in a manner well known in art.

Pole piece 50 includes an upper cylindrical portion 58, a centrally located circular, radial flange portion 60 and the lower reduced diameter cylindrical pole 48. The circular, radial flange portion 60 is slidably received at its outer peripheral edge within the cylindrical upper wall 28 of the body 12 to thereby close the enlarged upper solenoid case portion 20 of the body 12 and retain the multi-functional coil assembly 18 therein. The pole piece 50 is axially retained within the upper cylindrical portion of the body 12 by welding or otherwise suitable bonding its flange portion 60 to the shoulder 62 along the upper, opened end of the wall 28.

Figure 4:
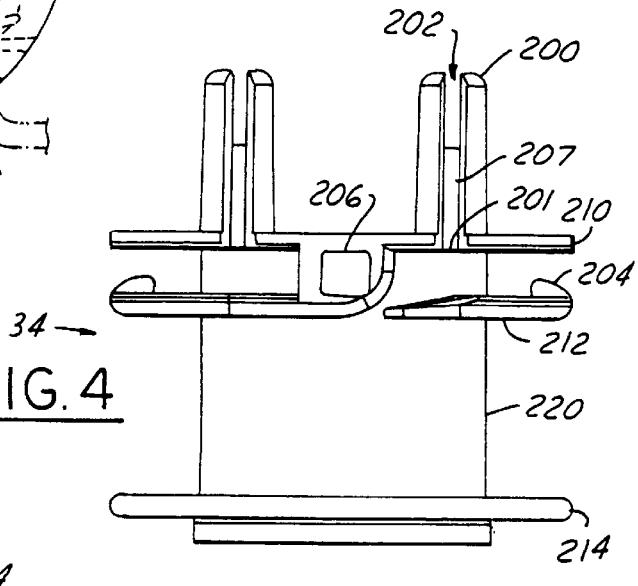
FIG. 4 is a side view of the bobbin according to a preferred embodiment of the invention.

Referring to FIG. 4, a preferred embodiment of the bobbin 34 is shown. The bobbin 34 has a first flange 214, a second flange 212, and a third flange 210. The bobbin 34 has open terminal posts 200 each having a bottom portion 201 that are located on the third flange 210. Terminal post diameters 202 are sized to allow terminals (shown as 209 in FIGS. 5, 6 and 7) to be locked therein during installation. In a preferred embodiment, the terminal post diameters 202 are 0.63+/−0.05 mm to lock terminals 52 of conventional design and size (0.64+/−0.1 mm diameter). The bobbin 34 contains two flange holding notches 207 located on the third flange 210 for securing the terminals 209 during installation prior to rotation. At least one flange locking notch 204 is used to capture the terminals after rotation and is located on the second flange 212. The strain relief 206 feature disposed between the second flange 212 and third flange 210 provides an engagement area to guide the wire 222 (shown in FIGS. 5, 6 and 7) during installation on a terminal 209 and provides strain relief in the wire after the terminal is fully rotated. A winding bay portion 220 that is located between the second flange 212 and the first flange 214 will eventually be wrapped with the wire 222 prior to installing the bobbin 34 in a fuel injector.

Referring to FIG. 4, a preferred embodiment of the bobbin 34 is shown. The bobbin 34 has a first flange 214, a second flange 212, and a third flange 210. The bobbin 34 has open terminal posts 200 having a bottom portion 201 that are located on the third flange 210. Terminal post diameters 202 are sized to allow terminals (shown as 209 in FIGS. 5, 6 and 7) to be locked therein during installation. In a preferred embodiment, the terminal post diameters 202 are 0.63+/−0.05 mm to lock terminals 52 of conventional design and size (0.64+/−0.1 mm diameter). The bobbin 34 contains two flange holding notches 207 located on the third flange 210 for securing the terminals 209 during installation prior to rotation. At least one flange locking notch 204 is used to capture the terminals after rotation and is located on the second flange 212. The strain relief 206 feature disposed between the second flange 212 and third flange 210 provides an engagement area to guide the wire 222 (shown in FIGS. 5, 6 and 7) during installation on a terminal 209 and provides strain relief in the wire after the terminal is fully rotated. A winding bay portion 220 that is located between the second flange 212 and the first flange 214 will eventually be wrapped with the wire 222 prior to installing the bobbin 34 in a fuel injector.

Figure 6:
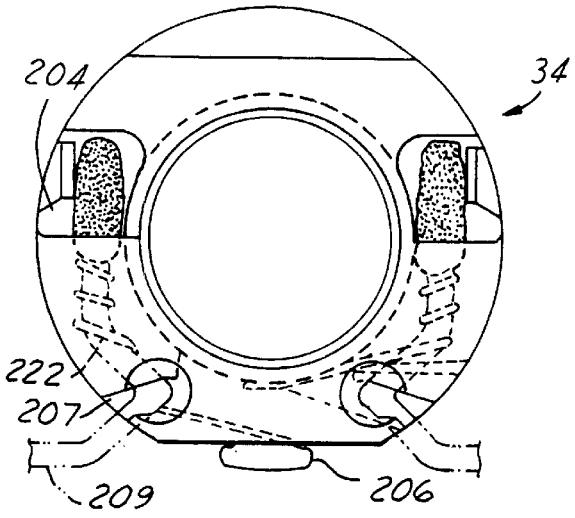
FIG. 6 is a top view of the bobbin with the terminals and wire attached in the rotated position according to a preferred embodiment of the invention.
Figure 5:
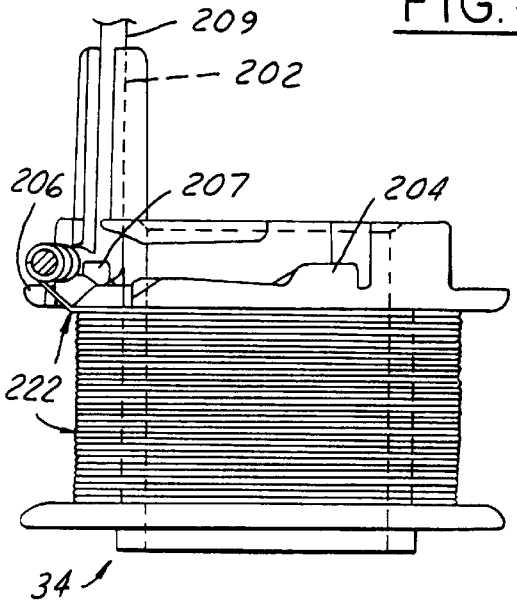
FIG. 5 is a side view of the bobbin where the terminals have been installed in the non-rotated position and where the wire has been attached according to a preferred embodiment of the invention.
Figure 7:
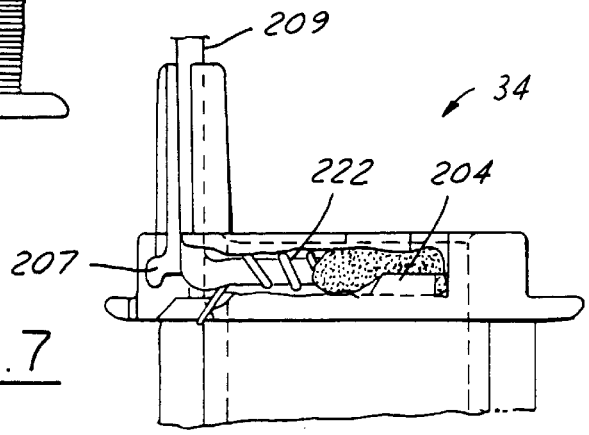
FIG. 7 is a side view of FIG. 6.

FIGS. 5 through 7 below show a preferred embodiment of the present invention at various stages of terminal assembly prior to placing the bobbin in a fuel injector.

FIG. 5 shows a preferred embodiment of the bobbin 34 during the initial installation phase of the terminals 209 and wire 222 prior to rotation. Each terminal 209 is engaged within the terminal post diameter 202 of one of the open terminal posts 200 such that a portion of the terminal 209 is engaged to the flange holding notch 207. The wire 222 is wrapped around the winding bay portion 220 of the bobbin 34 and each end of the wire 222 is fluxed and soldered to a terminal 209.

In FIGS. 6 and 7, the terminal 209 is shown in the rotated position. The terminal 209 has a wire 222 wrapped around a portion of the terminal 209 that is soldered or otherwise attached to the terminal 209. The terminal 209 has been rotated into the bobbin 34 such that the end of the terminal 209 is engaged between the flange locking notch 204 and the bobbin 34. The flange locking notch 204 eliminates the need for a locking clip (not shown) to be placed on the bobbin 34 to cover the end of the terminals 209.

In a preferred embodiment of the present invention, the bobbin 34 is manufactured from injection molded nylon 6/6 or a similar plastic that incorporates the open terminal posts 200, the flange locking notch 204, and the flange holding notches 207.

In operation, the assembly of the bobbin 34 with the terminals 209 and the wire 222 occurs in one operation with one operator, whereas at least one additional operation (and possibly one additional operator) is needed to attach the clip in previous embodiments. The improved method comprises pressing each terminal 209 through one of the open terminal posts 202 via a translational push such that a portion of each terminal 209 is disposed within one or the other flange holding notch 207; wrapping a wire 222 around a winding bay portion 220 of the bobbin 34; securing the wire 222 to each terminal 209; and rotating the two terminals 209 such that each terminal 209 is disposed within the flange locking notch 204. The bobbin 34 is then available to be placed in a fuel injector and connected to a power source as described above.

While one particular embodiment of the invention has been shown, it will be understood, of course, that the invention is not limited thereto since modifications may be made by those skilled in the art, particularly in light of the following teachings. It is therefore contemplated by the appended claims to cover any such modifications as incorporate those features that constitute the essential features of these improvements within the true spirit and scope of the invention.

What is claimed is:

1. A bobbin for use in a fuel injector comprising:

a first flange;

a winding bay portion adjacent to said first flange;

a second flange having a flange locking notch adjacent to said winding bay portion; and a third flange adjacent to said second flange, said third flange having a first terminal post with a first hollow portion having a first diameter to accept a first terminal, said third flange having a second terminal post with a second hollow portion having a second diameter to accept a second terminal, wherein the diameter of said first diameter and said second diameter are substantially equal.

2. A bobbin according to claim 1, further comprising said first terminal having a first terminal diameter and said second terminal having a second terminal diameter terminal, wherein the diameter of said first terminal diameter and said second terminal diameter are substantially equal.

3. A bobbin according to claim 2, wherein said first terminal is disposed within said first terminal post and said second terminal is disposed within said second terminal post.

4. A bobbin according to claim 3, further comprising a wire having a first end and a second end, said wire being wrapped around said winding bay portion and secured to said first terminal and said second terminal.

5. A bobbin according to claim 4, wherein said wire is coupled to said first terminal by soldering and wherein said second end is coupled to said second terminal by soldering.

6. A bobbin according to claim 5, wherein said first terminal and said second terminal are disposed within said flange locking notch.

7. A bobbin according to claim 6, wherein said first terminal post comprises a first open terminal post and said second terminal post comprises a second open terminal post.

8. A bobbin according to claim 7, wherein said third flange further comprises a first holding notch and a second holding notch, wherein said first terminal is further disposed within said first holding notch and wherein said second terminal is further disposed within said second holding notch.

9. A bobbin according to claim 1, wherein said first flange, said second flange, said winding bay portion and said third flange are integrally molded from a plastic.

10. A bobbin for use in a fuel injector comprising:

a first flange;

a winding bay portion adjacent to said first flange;

a second flange adjacent to said winding bay portion; and a third flange adjacent to said second flange, said third flange having a first open terminal post and a second open terminal post and a first flange holding notch and a second flange holding notch.

11. A bobbin according to claim 10, wherein a first terminal and a second terminal are coupled to the bobbin.

12. A bobbin according to claim 11, wherein said first terminal is disposed within said first open terminal post and said first flange holding notch and wherein said second terminal is disposed within said second open terminal post and said second flange holding notch.

13. A bobbin according to claim 12, wherein a wire having a first end and a second end is wrapped around said winding bay portion and coupled to said first terminal and said second terminal.

14. A bobbin according to claim 13, wherein said first end is coupled to said first terminal by soldering and wherein said second end is coupled to said second terminal by soldering.

15. A bobbin according to claim 14, wherein said second flange further comprises a flange locking notch, wherein said first terminal and said second terminal are disposed within said flange locking notch.

16. A bobbin according to claim 10, wherein said first flange, said second flange, said winding bay portion and said third flange are integrally molded from a plastic.

* * * * *